US006902691B2

(12) United States Patent
van Haag et al.

(10) Patent No.: US 6,902,691 B2
(45) Date of Patent: Jun. 7, 2005

(54) PROCESS FOR OPERATING A CALENDAR

(75) Inventors: Rolf van Haag, Kerken (DE); Eva Scheidler, Nattheim (DE); Robert Wolf, Herbrechtingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 375 days.

(21) Appl. No.: 10/192,529

(22) Filed: Jul. 11, 2002

(65) Prior Publication Data

US 2003/0026864 A1 Feb. 6, 2003

(30) Foreign Application Priority Data

Jul. 12, 2001 (DE) ..... 101 33 890

(51) Int. Cl.[7] ..... B29C 43/24; B29C 43/58; B30B 3/04

(52) U.S. Cl. ..... 264/40.1; 264/175

(58) Field of Search ..... 264/40.1, 175

(56) References Cited

U.S. PATENT DOCUMENTS

| | | | |
|---|---|---|---|
| 3,044,392 | A | 7/1962 | Minarik |
| 3,240,148 | A | 3/1966 | Varga |
| 4,117,054 | A | 9/1978 | Salo |
| 4,348,952 | A | 9/1982 | Gooch |
| 4,516,491 | A | 5/1985 | Winter |
| 5,501,145 | A | 3/1996 | Fromm |
| 5,961,899 | A | 10/1999 | Rossetti et al. |
| 6,199,476 | B1 | 3/2001 | Kayser |
| 6,305,280 | B1 | 10/2001 | Beckers |
| 2002/0060021 | A1 | 5/2002 | Kayser et al. |

FOREIGN PATENT DOCUMENTS

| | | |
|---|---|---|
| DE | 19601293 | 7/1997 |
| DE | 19815339 | 10/1999 |
| EP | 949378 | 10/1999 |
| EP | 1127977 | 8/2001 |
| WO | 99/25921 | 5/1999 |

OTHER PUBLICATIONS

Document "Calender Vibration—A Simulation Study and a Cure," Tappi Journal, vol. 52, No. 7, Jul. 1969, pp. 1356 through 1361.

Document "Calender barring on paper machines—practical conclusions and recommendations," Tappi Journal, vol. 58, No. 8, Aug. 1975, pp. 147 through 151.

"Calender barring on paper machines—practical conclusions and recommendations", Tappi Journal, vol. 58, No. 8, Aug. 1975, pp. 147–151.

Article by J. R. Parker et al."Analysis and Control of Calender Barring" Pulp & Paper Canada, vol. 76, No. 10, Oct. 1975, pp. 89–91.

Article by J. B. A. Epton et al."Glättwerk–Barring und Nasspressenvibration" Wochenblatt Für Papierfabrikation 17, 1981, pp. 616–622.

Article by J. R. Parker"Investigation of Vibrations and Disturbances" Pulp & Paper Canada, vol. 80, No. 7, Jul. 1979, pp. 39–43.

Article by L. Huser et al."Selbsterregte Schwingungen in Mehrwalzen–Glättwerken" Escher Wyss Mitteilungen 1/2, 1980, pp. 200–207.

M, Hermanski, "Barringbildung am Glattkalander einer Papiermaschine"Das Papier, Nr. 9, 1995, pp. 581–590.

*Primary Examiner*—Leo B. Tentoni
(74) *Attorney, Agent, or Firm*—Greenblum & Bernstein, P.L.C.

(57) ABSTRACT

Process for operating a calender having a roll stack formed by a plurality of rolls resting against one another in a press direction along a stack plane, at least one of the rolls including an elastic surface. The process includes determining whether a barring pattern has occurred on at least one of the rolls, determining a wavelength of the barring pattern, and displacing at least one of the rolls based upon the wavelength.

25 Claims, 2 Drawing Sheets

PROCESS FOR OPERATING A CALENDAR

CROSS-REFERENCE TO RELATED APPLICATIONS

The present application claims priority under 35 U.S.C. §119 of German Patent Application No. 101 33 890.2, filed on Jul. 12, 2001, the disclosure of which is expressly incorporated by reference herein in its entirety.

BACKGROUND OF THE INVENTION

1. Field of the Invention

The invention relates to a process for operating a calender with a roll stack that features two end rolls and several middle rolls arranged therebetween. The rolls rest against one another in a press direction, with at least one roll featuring an elastic surface.

2. Discussion of Background Information

Such calenders are used in particular to glaze paper or cardboard webs. The invention is described below on the basis of the treatment of a paper web. However, it can also be used in the same way with other material webs, with which similar problems occur.

During the glazing of a paper web, the paper web is guided through a calender and into nips that are formed between hard and soft rolls (a soft roll is a roll with an elastic surface). In this way, the paper web is acted upon by increased pressure and, if necessary, also by increased temperature. In the case of calenders of more recent construction types, e.g., the "Janus calenders," rolls are used which are covered with a plastic coating. It has been observed that in many cases crosswise stripes occur on the paper web after a certain working time. As soon as these stripes become visible, the paper web becomes useless and forms waste. The reasons for this so-called barring formation have not yet been conclusively established. However, it is assumed that they are the effects of a vibration phenomenon. However, vibrations are virtually unavoidable in a calender.

In the barring formation, the elastic surface of the soft roll is changed. It has not yet been conclusively established precisely what this change comprises. The following possibilities are currently assumed: the roll develops a waviness on the surface, i.e., a hill and valley structure, that the roll becomes polygonal, or that the roll develops alternating zones of varying surface quality in the circumferential direction, e.g., varying roughness. Regardless of the particular type of change, after the barring formation, periodic stripes appear on the circumference of the roll running in the axial direction. As a result, corresponding stripes then appear on the paper web, whereby the paper web is to be considered as waste, i.e., the web is rejected material, by the time the stripes become visible at the latest.

When a barring occurs, the roll that causes the barring formation must be removed and reground or finished. The service life of such a soft roll is therefore significantly limited.

The barring phenomenon also occurs in other calender stacks, i.e., from calenders that are formed solely of hard rolls. However, the development of the barring on the paper web takes substantially longer. It is assumed that the barring formation is to be attributed to other causes, in particular interferences in the paper web.

In "Calender Vibration—A Simulation Study and a Cure," Tappi Journal, Vol. 52, No. 7, July 1969, pages 1356 through 1361, it is proposed to embody a guide roll such that its position can be changed relative to the roll stack. This is intended to simulate a change in diameter of a roll.

The document "Calender barring on paper machines—practical conclusions and recommendations," Tappi Journal, Vol. 58, No. 8, August 1975, pages 147 through 151, proposes a similar solution, whereby it is alternatively proposed to displace the rolls between 20 mm and 60 mm relative to the roll stack. However, this displacement has the disadvantage that it changes the geometry of the roll stack relatively drastically, which can have a negative impact on the line loads and the line load distributions in the individual nips.

The use of plastic-coated rolls has led to a new type of barring, in which patterns impress themselves on the surface of the soft rolls in a relatively short time.

SUMMARY OF THE INVENTION

The invention proposes to increase the service life of a soft roll in a calender.

This is attained with a process of the type mentioned at the outset in that on the appearance of a barring pattern on the circumference of a soft roll, a wavelength of the barring pattern is determined, and that a roll displacement is made crosswise to the pressing direction depending on this wavelength.

As a rule, a barring pattern can be determined on the surface of a roll before this barring pattern impresses itself in the paper web in the form of crosswise stripes. If measures are therefore taken in good time to prevent the stronger impression of the barring pattern, the service life of the roll can be increased. This is based on considerations which will be hereinafter be described.

A roll stack that is formed of several rolls has a plurality of natural frequencies. This does not refer to the natural frequencies of the individual rolls, such as, e.g., natural frequencies in bending, but to the natural shapes of vibrations that result from the vibrating roll masses on the spring and damping systems of the interposed plastic coatings of the "soft" rolls. A running calender produces exciter forces, the frequencies of which are composed of the multiple of the roll rotational speeds. These exciter forces can be due to inhomogeneities, anisotropies or geometry errors (out of roundnesses) of the rolls. Fluctuations in paper thickness of the paper web running through the calender can also stimulate the roll stack. This is because a paper web running into the calender is still in a very rough state before the glazing process. In addition, a paper web is never free from basis weight or thickness fluctuations. If these fluctuations are analyzed with the aid of a FFT analysis of their frequencies, as a rule a wide-band noise is determined, which contains all the frequencies. If one of these exciter frequencies meets a natural frequency, the vibration system of the calender responds with enlarged vibration amplitudes. These resonance points cannot be constructively avoided because of the large number of possible exciters and the large number of possible natural shapes of vibrations. As a rule, the vibration system is also so greatly damped and the exciter forces are so small that the resulting vibration movements are not directly disruptive. Over a more or less extensive period of time, however, these vibration movements are impressed into the plastic coatings of the elastic rolls.

The nearest integral multiples of the roll rotational frequency are usually impressed into the rolls as a pattern. This results in a regeneration of the vibration. The vibration amplitudes then increase exponentially. They are expressed, on the one hand, as or in an increased noise level (up to more than 120 dB(A)), and on the other hand, as or in periodic fluctuations in thickness of the paper web running through. Varying periods of time are observed in practice in which these regeneration phenomena develop, which are expressed in barrings. Some days or weeks usually pass until this phenomenon has grown so much that it disrupts the production process.

If the barring patterns on the surface of the roll are analyzed, the wave pattern can be determined, and it can be found whether the wavelength is an integral fraction of the roll circumference. This information can then be evaluated and the roll can then be displaced crosswise to the press direction by an amount which takes into account this wavelength information. Since the wavelength information is used specifically, the displacement of the roll can be kept constant again for some time. A displacement of the roll need occur, therefore, only at larger intervals, i.e., once in a while, rather than in a continuous manner. The calender can thus be operated until a barring pattern has developed so clearly on the surface of a roll that disruptions are to be feared (or determined to likely occur) in the foreseeable future. The appearance of such a barring pattern can be determined, e.g., by vibration or oscillation measurements on the calender or even on each individual roll. If the roll displacement is made at a time which is shortly before a "critical" moment at which the roll actually would need to be replaced, it can be achieved that the barring pattern changes or even completely disappears, so that the service life of the roll can be almost doubled, or as a rule be lengthened by at least 30%, by way of a single displacement procedure.

The amount of roll displacement is preferably smaller than the wavelength. This approach has several advantages. For one thing, the displacement movement is limited, i.e., disruptions resulting from a removal of the roll from the roll plane of the calender are kept to a minimum. For another, the constructive or handling-related measures that must be taken for the roll displacement are limited. In principle, the roll displacement could theoretically also be enlarged by integral multiples of the wavelengths. However, the limiting the displacement to the smallest possible distance provides the above-mentioned advantages.

A roll displacement is preferably made on the roll on which the barring pattern appears. The disruption is thus directly eliminated where it developed. With regard to the middle rolls in particular, two nips can then be used for eliminating the barring patterns.

It is preferably provided that the amount of roll displacement is made which causes a difference in distance on the surface of the roll of half a wavelength in a first case, and of a quarter wavelength in a second case, whereby in the first case a barring pattern has appeared on the surface of the roll which pattern should be eliminated, and in the second case an elimination is not necessary. With this approach it is assumed that the barring pattern occurred on the surface of the roll due to a vibration, in which the neighboring roll, or the neighboring rolls, always exert a pronounced strain on the roll at certain points on the circumference of the roll, and exert a less pronounced strain at other points which are displaced from them by half a wavelength. Moreover, the middle rolls, in which the development of such barring patterns can be observed with particular frequency, are strained by the interaction of both neighboring rolls. If the distance on the roll surface between two nips is changed by half a wavelength, i.e., lengthened or shortened by half a wavelength, the "wave hills" will always be located at the point of the highest strain, and the "wave valleys" at the point of the lowest strain, given otherwise unchanged conditions. In this way, the barring pattern will thus change relatively quickly. Although it must thus be accepted that a new barring pattern will develop, the time it takes for the "old" barring pattern to disappear and the time it takes for the formation of the "new" barring pattern, act to prolong the service life of the roll. If the elimination of the barring pattern is not (yet) necessary, it can also be provided that the distance on the roll surface between two nips is changed by only a quarter wavelength. If barring patterns have previously formed which have not yet exceeded a tolerable level, an elimination of barring patterns is often not necessary at all.

A roll displacement of half the difference in distance is preferably made if the roll is a middle roll. The difference in distance is basically the difference in running time between two nips. If half of the difference in distance is attributed to each of these two nips, it is sufficient to displace the roll in total by approximately half of this difference in distance. Displacement movements of the roll are thus kept extraordinarily low. Although the displacement must be made relatively precisely, this can be done without difficulty as described below.

A difference in distance of a quarter wavelength is preferably adjusted when exchanging a roll for a replacement roll of the same construction. It can be assumed that the same vibration phenomena occur with a replacement roll of the same construction. However, since a barring pattern has not yet occurred with a replacement roll, an elimination is not necessary either. A preventive measure can therefore be taken to ensure that the barring pattern will not occur, and by way of displacing the roll, as opposed to a situation in which barring patterns have occurred. Although there is no guarantee with this approach that another barring pattern will not occur, the probability of this happening is reduced. If another barring pattern forms, it can again be eliminated by way of the measures described above. The service life of the roll is increased in any event.

The roll displacement is preferably made by changing the length of a lever on which the roll is supported. This is a relatively simple measure for displacing the roll. For a time the roll can then remain fixed in the position which has been determined by changing the length of the levers.

It is particularly preferred here for a spacer to be inserted between the roll bearing and the levers. This spacer can be matched to the wavelength with relative precision. The appropriate displacement can then be made with adequate precision by way of the choice of a suitable spacer.

The invention also provides for a process for operating a calender having a roll stack formed by a plurality of rolls resting against one another in a press direction along a stack plane, at least one of the rolls comprising an elastic surface. The process includes determining whether a barring pattern has occurred on at least one of the rolls, determining a wavelength of the barring pattern, and displacing at least one of the rolls based upon the wavelength.

The plurality of rolls may comprise two ends rolls and several middle rolls. The plurality of rolls may comprise soft rolls and hard rolls. The determining whether a barring pattern has occurred may comprise observing an appearance of at least one of the rolls. The determining whether a barring pattern has occurred may comprise observing an appearance of a circumference surface of at least one of the rolls. The determining whether a barring pattern has occurred may comprise observing an appearance of the elastic surface of at least one of the rolls. The displacing may comprises cross wise displacing of at least one of the rolls based upon the wavelength. The displacing may comprise moving at least one of the rolls by an amount which is smaller than the wavelength. The determining whether a barring pattern has occurred may comprise determining whether a barring pattern has occurred on a particular roll, and the displacing may comprise displacing the particular roll based upon the wavelength. The determining whether a barring pattern has occurred may comprise detecting an appearance of a barring pattern on a particular roll, and the displacing may comprise displacing the particular roll based upon the wavelength.

The displacing may comprise moving at least one of the rolls by an amount which is approximately equal to one-half the wavelength. The displacing may comprise moving a middle roll by an amount which is approximately equal to one-half the wavelength. The displacing may comprise moving at least one of the rolls by an amount which is approximately equal to one-quarter the wavelength. The displacing may comprise moving a middle roll by an amount which is approximately equal to one-quarter the wavelength. The process may further comprise exchanging at least one of the rolls with a new roll. The displacing may comprise changing a length of a roll supporting lever. The displacing may comprise changing the length of the roll supporting levers. The displacing may comprise changing the length of the roll supporting levers via spacers. The displacing may comprise changing the length of the roll supporting lever via a spacer. The changing may comprise inserting the spacer between a roll bearing and the roll supporting lever. The displacing may comprise adjusting a length of a roll supporting lever. The displacing may comprise adjusting the length of the roll supporting lever via a spacer. The displacing may comprise adjusting the length of roll supporting levers via spacers. The adjusting may comprise inserting the spacer between a roll bearing and the roll supporting lever.

The invention also provides for a process for operating a calender having a roll stack formed by a plurality of rolls resting against one another in a press direction along a stack plane, at least one of the rolls comprising an elastic surface. The process comprises observing whether a barring pattern has occurred on at least one of the rolls, determining a wavelength of the barring pattern, and displacing at least one of the rolls based upon the wavelength.

The instant application expressly incorporates by reference in their entireties, the disclosures of commonly owned and concurrently filed U.S. patent application Ser. No. 10/192,499 filed on Jul. 11, 2002 and entitled "CALENDER AND PROCESS FOR OPERATING A CALENDER"; U.S. patent application Ser. No. 10/192,530 filed on Jul. 11, 2002 and entitled "CALENDER AND PROCESS FOR ARRANGING ROLLS IN A ROLL STACK OF A CALENDER"; and U.S. patent application Ser. No. 10/192,554 filed on Jul. 11, 2002 and entitled "PROCESS FOR OPERATING A CALENDER".

The invention still further provides for a process for operating a calender having a roll stack formed by a plurality of rolls resting against one another in a press direction along a stack plane, at least one of the rolls comprising an elastic surface. The process comprises observing whether a barring pattern has occurred on the elastic surface, determining a wavelength of the barring pattern, and displacing the elastic surface based upon the wavelength.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
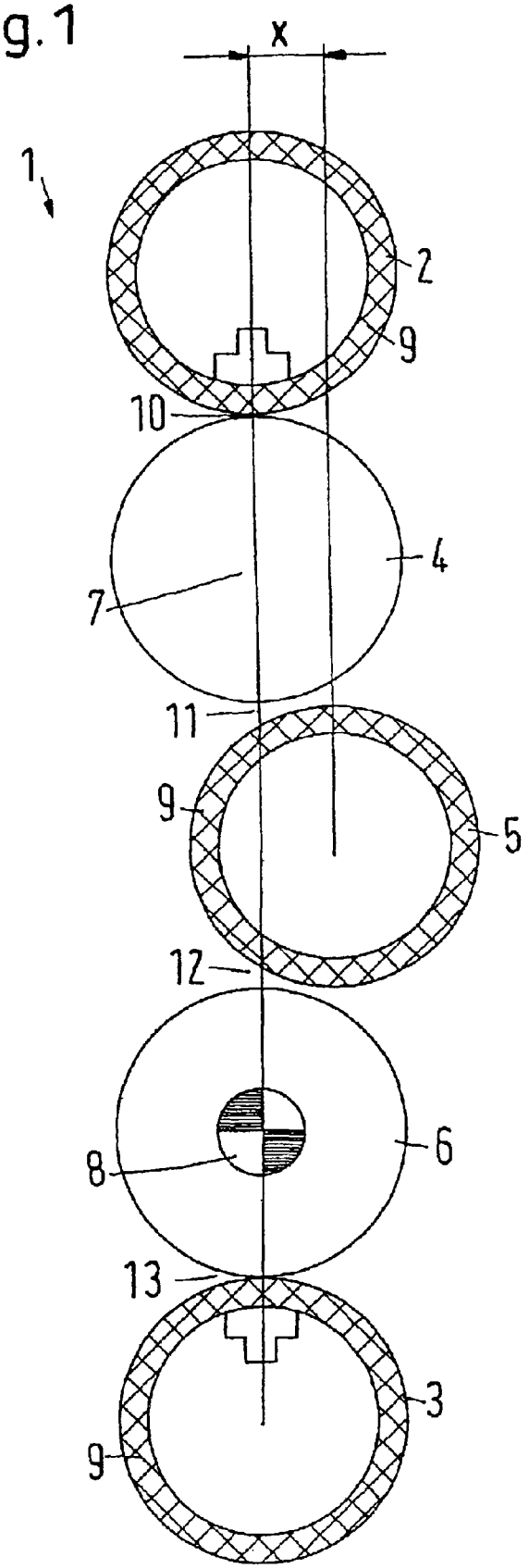
FIG. 1 shows a diagrammatic representation of a calender.

FIG. 1 shows in diagrammatic form a calender 1 with two end rolls 2, 3 which are embodied as load-deflection rolls, and three middle rolls 4–6, which together form a roll stack. Roll 2 is an upper end roll, roll 3 is a lower end roll, roll 4 is an upper middle roll, roll 5 is an intermediate middle roll, roll 6 is a lower middle roll. The roll stack includes a roll plane 7, in which the center axes of all rolls 2–6 lie when the rolls 2–6 are arranged exactly above one another. The press direction also lies in this roll plane 7 for the purposes of the following description, i.e., the direction in which the rolls 2–6 are pressed against one another.

Further details of the calender 1 are represented only in diagrammatic form, such as a drive 8, or omitted completely, such as the system for heating the individual rolls (such features being conventionally known). The two end rolls 2, 3 and the middle roll 5 utilize an elastic coating 9, which is drawn with exaggerated thickness.

Figure 2:
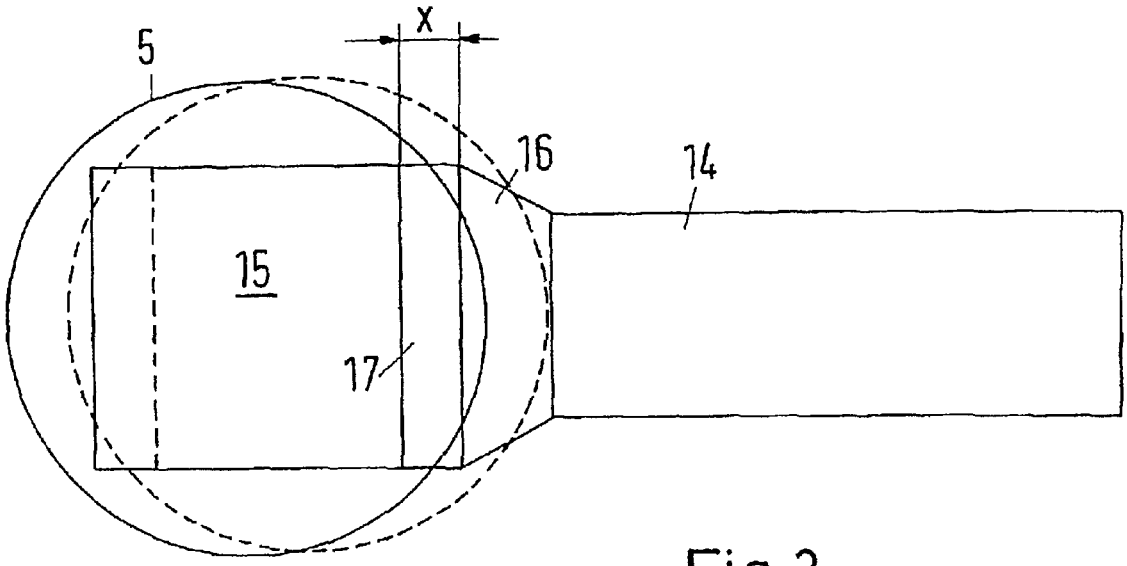
FIG. 2 shows one way for adjusting the displacement.

During the operation of the calender, the rolls 2–6 form nips 10–13 in a known manner. The material web is passed or guided through the nips when it is treated. All the nips are embodied in FIG. 1 as so-called soft nips, i.e., they use one hard and one soft roll. In operation it can be seen that surface patterns develop on the soft rolls, which, when they have exceeded a critical size, become impressed into the paper web. In order to prevent such a barring pattern or to reduce a barring pattern already formed, the invention provides that the particular roll concerned, in the present case the middle roll 5, can be displaced by a distance X relative to the roll plane 7. The approach or method of accomplishing this will be explained in connection with FIG. 2.

The roll 5 is supported on its ends via levers 14 (only one of which is shown). These levers 14 are flexibly suspended in a support of the calender (not shown in further detail). The roll 5 is mounted on a bearing housing 15 which can be screwed or otherwise fixed or secured onto a bearing surface 16 of the levers 14. In an initial position, the roll 5 is in the position shown by dashed lines. If it is then determined that a barring pattern develops on the surface in this position, the roll 5 is displaced by the distance X, by a spacer 17 being inserted between the bearing surface and the bearing housing 15. To this end the bearing housing 15 is separated from the bearing surface 16, the spacer 17 is inserted and the bearing housing 15 is reattached to the lever 14. The thickness of the spacer 17 is then the distance X. This distance X can be adjusted with a relatively high degree of precision. The determination of this distance X is explained on the basis of FIG. 3.

Figure 3:
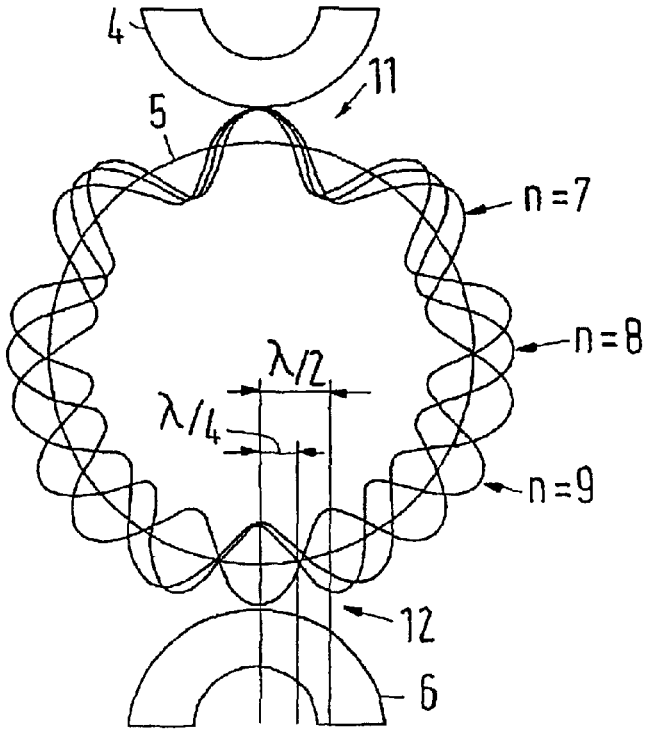
FIG. 3 shows a diagrammatic representation for explaining the development of a barring pattern on a roll.

FIG. 3 shows the roll 5, the roll 4 located above it, and the roll 6 located below it. Various reference wavinesses are shown with exaggerated amplitudes, namely a waviness in which seven waves run around the circumference of the roll 5, one with eight waves and one with nine waves. The numbers n=7, 8, 9 were chosen for reasons of clarity. In the case of real rolls, a correspondingly higher number of waves would develop over the circumference of the roll, e.g., in the range of 30 to 50. In the case of such a high number of waves running around the circumference of the roll 5, it can be assumed in a first approximation that the curvature of the roll 5 would not matter in the case of a small displacement movement of the roll 5 relative to the roll plane 7, which is smaller than a wavelength.

If a barring pattern with a wavelength $\lambda$ has occurred, the roll 5 is displaced relative to the roll plane 7, i.e., relative to the nips 11, 12, such that on the one side the distance between the two nips 11, 12 is increased by half a wavelength $\lambda/2$, and on the other side reduced by this half a wavelength $\lambda/2$. For this only a displacement X is necessary, which corresponds to $X=\lambda/4$, because the desired difference in distance between the two nips 11, 12 is thus produced.

In the case of a difference in distance of $\lambda/2$, no strain occurs at the points on the circumference of the roll 5 which previously were subjected to great strain and where accordingly wave valleys have developed. This strain arises instead at the wave hills, where the corresponding strain had previously been lacking. The strains result from the vibration movements of the three rolls 4, 5, 6 relative to one another. It can thus be achieved by a difference in distance of $\lambda/2$, that a barring pattern already formed, changes and in the course of time disappears. In this case there is a risk of another barring pattern forming, the wavelength of which is close to the wavelength of the original barring pattern. If the original barring pattern had a wavelength of U/n, where U is the circumference of the roll 5, the new barring pattern will possibly have a wavelength of $U/(n\pm1)$. However, it will take some time for such a new barring pattern to develop to the extent that it is disruptive.

If the barring pattern has not yet developed to the extent that it is disruptive, or if a replacement roll is used which has the same construction as the original roll where the barring pattern appeared, a roll displacement X can also be selected which is exactly half as big, i.e., $X=\lambda/8$. In this case, the difference in distance is changed by the amount $\lambda/4$. With this difference in distance the barring pattern previously produced will not become any larger, or a new barring pattern with this wavelength will not develop.

Through the static roll displacement which causes a lengthening of the distance between the two nips 11, 12 of a quarter wavelength $\lambda/4$, it can be assumed that the disturbances will develop separately from each other with half the intensity, given the same excitation by the coupling with the two neighboring rolls, so that in theory a doubling of the service life can be achieved.

As a rule, in practice it will not be possible to ensure that rolls are actually identical in all the parameters, even if a replacement roll has the same construction as the roll to be replaced. Nevertheless, it can be assumed that the service life of the replacement roll can be prolonged by a static roll displacement oriented to the wavelength of the barring pattern on the surface of the roll to be replaced, if, e.g., the replacement roll is displaced by one eighth wavelength $\lambda/8$ relative to the roll plane 7, so that the distance between the two nips is increased by $\lambda/4$ on one side and reduced by $\lambda/4$ on the other side. Even if the replacement roll does not then react with exactly the same response to the vibrations of the calender, it can be assumed that the service life will be prolonged compared with a simple replacement without such a measure.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for operating a calender having a roll stack formed by a plurality of rolls resting against one another in a press direction along a stack plane, at least one of the rolls comprising an elastic surface, the process comprising:

determining whether a barring pattern has occurred on at least one of the rolls;

determining a wavelength of the barring pattern; and displacing at least one of the rolls based upon the wavelength, wherein the displacing comprises cross-wise displacing of at least one of the rolls based upon the wavelength.

2. The process of claim 1, wherein the plurality of rolls comprises two ends rolls and several middle rolls.

3. The process of claim 1, wherein the plurality of rolls comprises soft rolls and hard rolls.

4. The process of claim 1, wherein the determining whether a barring pattern has occurred comprises observing an appearance of at least one of the rolls.

5. The process of claim 1, wherein the determining whether a barring pattern has occurred comprises observing an appearance of a circumference surface of at least one of the rolls.

6. The process of claim 1, wherein the determining whether a barring pattern has occurred comprises observing an appearance of the elastic surface of at least one of the rolls.

7. The process of claim 1, wherein the displacing comprises moving at least one of the rolls by an amount which is smaller than the wavelength.

8. The process of claim 1, wherein the determining whether a barring pattern has occurred comprises determining whether a barring pattern has occurred on a particular roll, and wherein the displacing comprises displacing the particular roll based upon the wavelength.

9. The process of claim 1, wherein the determining whether a barring pattern has occurred comprises detecting an appearance of a barring pattern on a particular roll, and wherein the displacing comprises displacing the particular roll based upon the wavelength.

10. The process of claim 1, wherein the displacing comprises moving at least one of the rolls by an amount which is approximately equal to one-half the wavelength.

11. The process of claim 1, wherein the displacing comprises moving a middle roll by an amount which is approximately equal to one-half the wavelength.

12. The process of claim 1, wherein the displacing comprises moving at least one of the rolls by an amount which is approximately equal to one-quarter the wavelength.

13. The process of claim 1, wherein the displacing comprises moving a middle roll by an amount which is approximately equal to one-quarter the wavelength.

14. The process of claim 1, further comprising exchanging at least one of the rolls with a new roll.

15. The process of claim 1, wherein the displacing comprises changing a length of a roll supporting lever.

16. The process of claim 1, wherein the displacing comprises changing a length of roll supporting levers.

17. The process of claim 16, wherein the displacing comprises changing the length of the roll supporting levers via spacers.

18. The process of claim 15, wherein the displacing comprises changing the length of the roll supporting lever via a spacer.

19. The process of claim 18, wherein the changing comprises inserting the spacer between a roll bearing and the roll supporting lever.

20. The process of claim 1, wherein the displacing comprises adjusting a length of a roll supporting lever.

21. The process of claim 1, wherein the displacing comprises adjusting a length of a roll supporting lever via a spacer.

22. The process of claim 1, wherein the displacing comprises adjusting a length of roll supporting levers via spacers.

23. The process of claim 1, wherein the adjusting comprises inserting a spacer between a roll bearing and a roll supporting lever.

24. A process for operating a calender having a roll stack formed by a plurality of rolls resting against one another in a press direction along a stack plane, at least one of the rolls comprising an elastic surface, the process comprising:

observing whether a barring pattern has occurred on at least one of the rolls;

determining a wavelength of the barring pattern; and displacing at least one of the rolls based upon the wavelength, wherein the displacing comprises cross-wise displacing of at least one of the rolls based upon the wavelength.

25. A process for operating a calender having a roll stack formed by a plurality of rolls resting against one another in a press direction along a stack plane, at least one of the rolls comprising an elastic surface, the process comprising:

observing whether a barring pattern has occurred on the elastic surface;

determining a wavelength of the barring pattern; and displacing a roll with the elastic surface based upon the wavelengths, wherein the displacing comprises cross-wise displacing of at least one of the rolls based upon the wavelength.

* * * * *